United States Patent [19]

Kasparek et al.

[11] 4,372,710

[45] Feb. 8, 1983

[54] APPARATUS FOR MANIPULATING FILTER ROD SECTIONS OR THE LIKE BETWEEN PRODUCING AND PROCESSING MACHINES

[75] Inventors: Alois Kasparek, Hamburg; Jürgen Burger, Marschacht, both of Fed. Rep. of Germany

[73] Assignee: Hauni-Werke Körber & Co. KG, Hamburg, Fed. Rep. of Germany

[21] Appl. No.: 168,292

[22] Filed: Jul. 11, 1980

[30] Foreign Application Priority Data

Jul. 20, 1979 [DE] Fed. Rep. of Germany ..... 2929406

[51] Int. Cl.[3] ..... B65G 51/02

[52] U.S. Cl. ..... 406/28; 198/572; 406/70; 406/77

[58] Field of Search ..... 406/10, 28, 70, 77, 406/82, 154; 198/347, 457, 461, 468, 524, 572, 573; 131/282, 283

[56] References Cited

U.S. PATENT DOCUMENTS

| | | | |
|---|---|---|---|
| 3,222,110 | 12/1965 | Kelley et al. | 406/82 |
| 3,397,922 | 8/1968 | Dearsley | 406/154 X |
| 3,608,972 | 9/1971 | Rudszinat | 406/82 X |
| 4,084,685 | 4/1978 | Hollenton et al. | 198/524 X |

FOREIGN PATENT DOCUMENTS 2641934 3/1977 Fed. Rep. of Germany .

*Primary Examiner*—Jeffrey V. Nase

*Attorney, Agent, or Firm*—Kontler, Grimes & Battersby

[57] ABSTRACT

A receiving station at the outlets of several pneumatic conveyor pipes which discharge discrete files of axially moving filter plugs accommodates a separating unit immediately downstream of the outlets and an orientation changing unit immediately downstream of the separating unit. The separating unit defines discrete lanes, one for each file of filter plugs. In each of the lanes, the filter plugs of the respective file are converted into a series of axially spaced filter plugs which continue to move lengthwise, and the filter plugs of each series are delivered into discrete upright ducts of the orientation changing unit wherein each series is transformed into a row whose filter plugs move sideways. The transport of filter plugs in each lane of the separating unit can be interrupted or resumed independently of any other lane in response to signals from photocells which monitor the transport of filter plugs in the conveyor pipes and/or in the ducts and transmit signals in response to detection of irregular or improper delivery of filter plugs to one or more sections or devices of the separating and/or orientation changing unit. This ensures that the orientation changing unit can deliver a continuous row of plugs to a processing machine or an intermediate conveyor even in the event of malfunction of one or more pipes, one or more sections of the separating unit and/or one or more devices of the orientation changing unit.

11 Claims, 3 Drawing Figures

APPARATUS FOR MANIPULATING FILTER ROD SECTIONS OR THE LIKE BETWEEN PRODUCING AND PROCESSING MACHINES

CROSS-REFERENCE TO RELATED CASE

The apparatus which is described in the specification and shown in the drawing of the present application is identical with that which is described and shown in our commonly owned copending application Ser. No. 160,289 filed June 17, 1980.

BACKGROUND OF THE INVENTION

The present invention relates to apparatus for manipulating filter rod sections or other rod-shaped articles which constitute or form part of smokers' products. More particularly, the invention relates to improvements in apparatus for manipulating filter rod sections or the like between one or more producing machines and one or more consuming or processing machines, for example, between one or more filter makers and a filter tipping machine. Still more particularly, the invention relates to improvements in apparatus wherein a pneumatic transporting unit receives rod-shaped articles from one or more producing or supplying machines and the articles which issue from such unit are delivered to one or more consuming or processing machines while simultaneously changing the direction of their movement from axial movement in the interior of the pneumatic transporting unit to sidewise movement preparatory to entry into a processing or consuming machine.

Apparatus of the type to which the present invention pertains are installed at a receiving station where the output of the pneumatic transporting unit is converted into one or more layers of rod-shaped articles which are admitted into the magazine of a filter tipping machine or into the receptacle or hopper of another processing or consuming machine. Pneumatic transporting units are used in many tobacco processing plants as superior substitutes for conventional chargers or trays which were popular one or more decades ago. The trays are suspended from an overhead conveyor system which transports empty trays to one or more producing machines and delivers filled trays to one or more consuming or processing machines wherein the contents of filled trays are dumped or otherwise transferred into hoppers, magazines or analogous receptacles. Reference may be had, for example, to commonly owned U.S. Pat. No. 3,662,880 granted May 16, 1972 to Kochalski et al. which discloses a machine for filling trays at the discharge end of a cigarette maker or the like. The manner in which the contents of trays can be evacuated into the magazine of a packing machine is disclosed, for example, in commonly owned U.S. Pat. No. 3,672,522 granted June 27, 1972 to Wahle et al.

An advantage of a pneumatic transporting unit is that it can convey rod-shaped articles through any desired distance and at an elevated speed. Moreover, the conveyor pipe of such transporting unit can be readily guided practically anywhere above or even below the floor level to occupy space which is available in a tobacco processing plant. A sender station at the receiving end of the conveyor pipe accommodates means for admitting rod-shaped articles into the inlet of the pipe, and the instrumentalities at the receiving station are designed to accept the articles which issue from the pipe and to change the direction of movement of such articles from axial movement to sidewise movement.

A receiving station of conventional design is disclosed in German Offenlegungsschrift No. 2,641,934. This station accommodates (a) a separating unit wherein the rod-shaped articles which issue from the outlet of a pneumatic conveyor pipe are spaced apart, as considered in the axial direction, and (b) a deflecting or orientation changing unit wherein the articles which arrive from the separating unit are caused to change the direction of their movement from axial movement to sidewise movement. The provision of clearances between successive articles which enter the separating unit is desirable because this allows for unimpeded changes in orientation of articles during transport through the orientation changing unit. The separating unit comprises a braking device which decelerates successive articles, as they issue from the outlet of the pneumatic conveyor pipe, so that the speed of all decelerated articles matches a preselected optimum speed. The braking device is followed by an accelerating device which increases the speed of successive articles leaving the braking device to thus provide the aforementioned axial clearances which allow for unimpeded deflection of articles in the orientation changing unit. The latter comprises an upright duct with parallel walls which define a channel having a width slightly in excess of the diameter of a rod-shaped article. A wedge-like or cam-shaped deflector and/or one or more air discharging nozzles in the channel serve to change the direction of movement of oncoming articles from axial movement to sidewise or transverse movement. The thus obtained row of rod-shaped articles is delivered to the magazine of a processing or consuming machine.

A drawback of the just described conventional receiving station is that its capacity is rather limited. Therefore, such station cannot be used for delivery of rod-shaped articles to a high-speed packing or filter tipping machine because the requirements of these machines are extremely high. Moreover, when the pneumatic conveyor pipe of the transporting unit which delivers articles to such conventional receiving station (i.e., to the braking device of the separating unit) is clogged or the transporting unit fails to function satisfactorily for another reason, the delivery of articles to the processing or consuming machine is interrupted with attendant losses in output. The same holds true if the separating unit and/or the orientation changing unit of the just described conventional apparatus fails to operate in the prescribed manner.

As mentioned above, the requirements of modern high-speed processing or consuming machines (such as packing machines for plain or filter cigarettes or filter tipping machines) are extremely high. Attempts to satisfy the requirements of such high-speed processing or consuming machines include the provision of pneumatic transporting units with two or more pneumatic conveyor pipes each of which delivers a discrete file of rod-shaped articles to a receiving station. For example, U.S. Pat. No. 3,222,110 to Kelly et al. discloses a composite transporting unit with several conveyor pipes which serve to receive cigarettes from several makers and to deliver cigarettes to a collecting station or to a processing machine. The units at the receiving station, i.e., at the outlets of the conveyor pipes, also define several lanes or paths for the transport of cigarettes therethrough. The number of lanes corresponds to the number of conveyor pipes, and each lane receives the output of a discrete pipe. As in the aforedescribed conventional structure which is disclosed in the German Offenlegungsschrift No. 2,641,934, the receiving station of Kelly et al. comprises a separating unit which receives cigarettes from the outlets of the conveyor pipes and is located upstream of a deflecting or orientation changing unit. The total number of conveyor pipes in the transporting unit is four. The separating unit comprises an endless conveyor belt for each pair of pipes, and each belt cooperates with a first roll to uniformize the speed of oncoming cigarettes as well as with a second roll which accelerates the cigarettes advancing beyond the first roll. Each roll has two peripheral grooves bounded by surfaces whose cross-sectional area is complementary to that of the external surfaces of wrappers on the cigarettes which issue from the respective pipes. A cigarette which extends in part into a groove is also engaged by the endless belt so as to be transported at a desired speed. The peripheral speed of each second roll is higher than the peripheral speed of the respective first roll, i.e., the cigarettes which advance beyond the first rolls are caused to move apart and to establish axial clearances or gaps which are needed to permit unimpeded deflection of cigarettes during travel through the orientation changing unit. The latter comprises four downwardly extending channels serving to discharge rows of cigarettes into a common junction zone which is located immediately at the inlet of a packing machine or at the inlet of a collecting station.

The mobile parts of the separating unit in the apparatus of Kelly et al. are driven by a prime mover. The prime mover transmits torque to a first shaft which is rigidly connected with both first rolls and to a second shaft which is rigidly connected with the two second rolls. Thus, when the prime mover is on, it drives both shafts and each of these shafts drives the corresponding pair of rolls at the selected speed which is higher in the case of the second shaft. The patented apparatus further comprises photocells which generate signals when the conveyor pipes of the transporting unit are clogged; such signals are used to interrupt the delivery of cigarettes to the separating unit at the receiving station. However, stoppage of delivery of articles to a lane of the separating unit does not entail any stoppage of the corresponding portion of the separating unit and/or corresponding portion of the orientation changing unit. Thus, whenever a single conveyor pipe of the transporting unit is clogged, or whenever a single lane of the separating and/or orientation changing unit at the receiving station which is disclosed in the patent to Kelly et al. requires insepection and/or repair, it is necessary to shut down the entire apparatus with attendant extremely high losses in output. Even short-lasting interruption of delivery of articles to a high-speed processing machine creates additional problems, especially when the nature of the machine is such that the material which is processed immediately after starting must be discarded.

Another drawback of the apparatus which is disclosed by Kelly et al. is that it does not embody any means for regulating the removal of articles from the aforementioned common junction zone which receives articles from the four channels of the orientation changing unit. This, too, can create problems if the operation of one or more portions of the orientation changing unit is unsatisfactory and/or if the rate of delivery of articles to the processing machine or to the collecting station must be varied for other reasons. In fact, it would be difficult to regulate the rate of transfer of articles from the orientation changing unit to the processing machine and/or to the collecting station because such station or machine is immediately adjacent to the junction zone.

OBJECTS AND SUMMARY OF THE INVENTION

An object of the invention is to provide a novel and improved apparatus for manipulation of filter rod sections, or other types of rod-shaped articles which constitute or form part of smokers' products, between one or more supplying or producing and one or more consuming or processing machines.

Another object of the invention is to provide a novel and improved apparatus which includes a multi-lane pneumatic transporting unit and multi-lane units disposed between such transporting unit and one or more processing machines or stations.

A further object of the invention is to provide an apparatus of the above outlined character wherein minor disturbances can be eliminated without appreciable losses in output.

An additional object of the invention is to provide an apparatus wherein the processing machine or machines can receive one or more continuous streams of rod-shaped articles even if the pneumatic transporting unit of such apparatus is operated at less than maximum capacity.

Another object of the invention is to provide an apparatus of the above outlined character wherein the processing machine or machines can receive a continuous stream of rod-shaped articles even in the event of malfunction of certain parts of one or more units which follow the outlets of pneumatic conveyor pipes and serve to effect controlled changes in orientation of articles on their way from the pneumatic transporting unit to the processing machine or machines.

A further object of the invention is to provide the apparatus with novel and improved means for regulating the rate of removal of articles so as to conform such rate to the rate of admission of articles.

An ancillary object of the invention is to provide the regulating means with devices which can detect malfunctions in all such parts of the apparatus wherein malfunctions are customary or more likely to occur than in other parts of the apparatus.

A further object of the invention is to provide an apparatus which, even though particularly suited for manipulation of filter rod sections or filter plugs, is equally suited for the manipulation of other types of rod-shaped articles which constitute or form part of smokers' products and can be transported in pneumatic conveyor pipes.

One feature of the invention resides in the provision of an apparatus for manipulating rod-shaped articles between at least one supplying or producing machine and at least one consuming or processing machine. The term "supplying or producing machine" is intended to embrace (among others) machines which turn out rod-shaped articles by converting other types of rod-shaped articles, e.g., filter tipping machines wherein rod-shaped filter plugs are united with plain cigarettes to form filter cigarettes, as well as any other machine or machines which deliver rod-shaped articles for transport to storage or further processing (e.g., packing); and the term "processing or consuming machine" is intended to embrace (among others) machines wherein rod-shaped articles are assembled with other types of products, packing machines, inspecting machines, as well as magazines or storing stations at or in which the rod-shaped articles are deposited, either temporarily or for relatively long intervals of time.

The improved apparatus comprises a pneumatic transporting unit having a plurality of discrete tubular conveyors (e.g., conveyors in the form of pipes) for the transport of articles along separate paths, each such tubular conveyor having an outlet serving to discharge the articles in the form of a single file wherein the articles move lengthwise (i.e., axially). The outlets may but need not be immediately adjacent to and parallel with each other. The apparatus further comprises a separating unit including discrete sections, one for each tubular conveyor, and each such section of the separating unit has means for converting the respective file of articles into a series of axially spaced articles which continue to move lengthwise. Thus, each section of the separating unit converts the corresponding file into a modified file or series of articles wherein the neighboring articles are separated from each other by clearances or gaps of preselected width or of a width which at least equals such preselected width. Each converting means comprises at least one rotary article engaging and advancing element (e.g., one or more rolls, drums or like rotary elements) and the apparatus includes adjustable drive means for rotating each such element independently of each other rotary element, i.e., each rotary element can be driven independently of the rotary element or elements in the other section or sections of the separating unit. Still further, the apparatus comprises an orientation changing or deflecting unit including discrete deflecting devices, one for each section of the separating unit. Each deflecting device comprises means for changing the direction of movement of successive articles of the series of articles issuing from the respective section of the separating unit so that each series of articles is transformed into a row wherein the articles move sideways.

For example, each section of the separating unit may comprise at least one first rotary article engaging and advancing element and at least one second rotary article engaging and advancing element which is located downstream of the first element, as considered in the direction of movement of articles in the corresponding series of articles. The drive means can include means for normally rotating the second element or elements of each section of the separating unit at a speed exceeding the speed of the corresponding first element or elements. This enables the first elements to uniformize the speed of oncoming articles of the respective files and the second elements to accelerate the thus treated articles in order to form the aforementioned clearances or gaps between the articles of each series.

The drive means may comprise a discrete drive for the rotary element or elements of each section of the separating unit and discrete adjusting means for each of the drives so that the rotary element or elements of any selected section can be started or arrested independently of the rotary element or elements of each other section.

Alternatively, the drive means can comprise a single prime mover which is common to all sections of the separating unit, a discrete drive for the rotary element or elements of each section of the separating unit, and means for transmitting torque from the prime mover to the drives. Each of the just mentioned drives may comprise an electromagnetic or otherwise constructed clutch, and the apparatus preferably further comprises means for engaging or disengaging the clutches independently of each other so that the rotary element or elements of any selected section of the separating unit can be started or arrested independently of the rotary element or elements of each other section.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
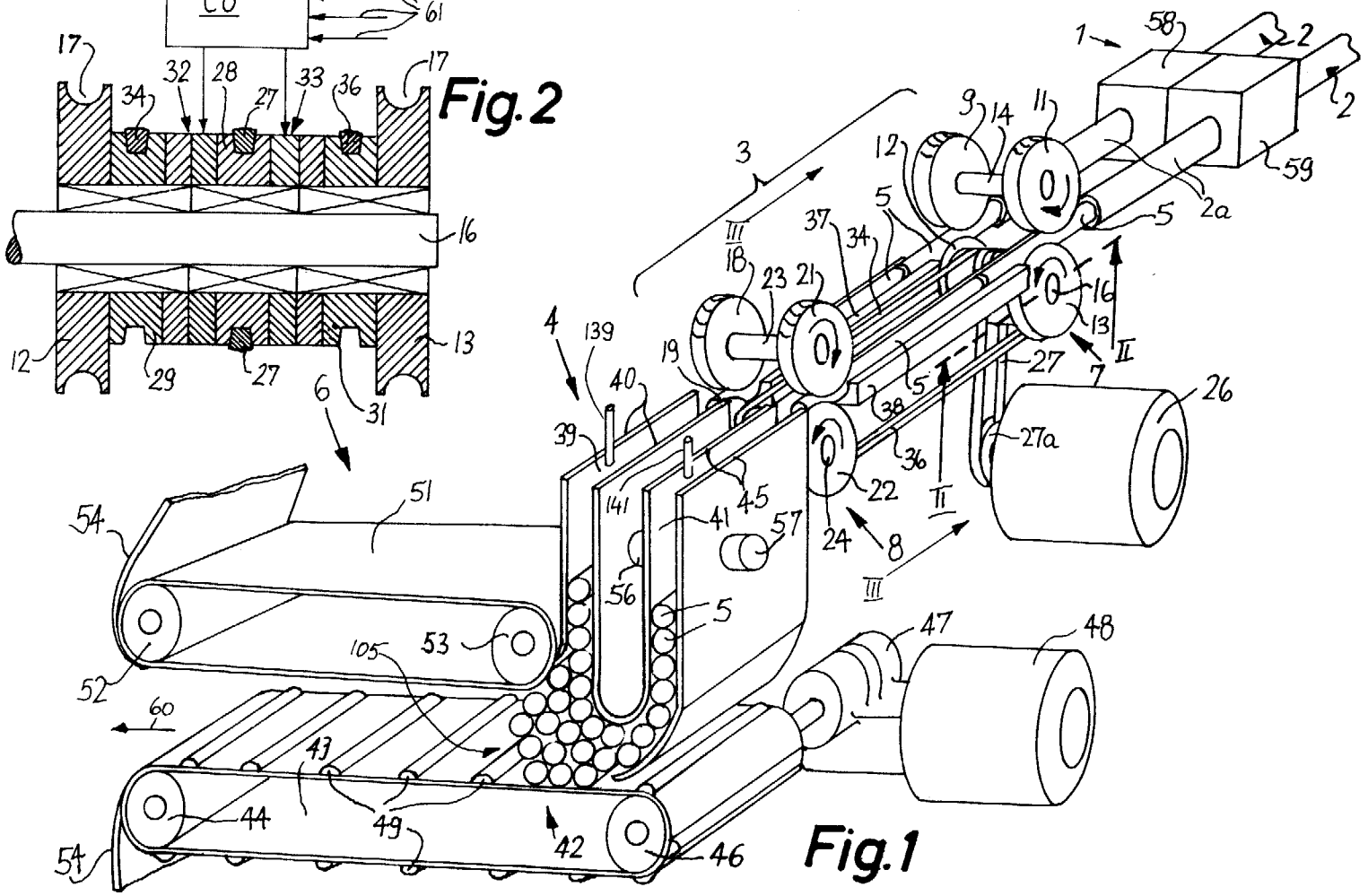
FIG. 1 is a perspective view of an apparatus which embodies one form of the invention and wherein the various units define two lanes for axial and sidewise transport of rod-shaped articles.

FIG. 1 illustrates an apparatus which is disposed at a receiving station for filter rod sections 5, The apparatus comprises a pneumatic transporting unit 1 which, in the illustrated embodiment, comprises two elongated tubular conveyors 2 (hereinafter called pipes) with rather closely adjacent parallel outlets 2*a*. The pipes 2 receive filter rod sections 5 from a sender (not shown) which, in turn, receives filter rod sections from a filter rod making machine. Each of the two pipes 2 delivers a discrete file of filter rod sections 5 which advance therein lengthwise, i.e., axially. The sections 5 in each of the pipes 2 can be immediately adjacent to each other.

The apparatus further comprises a separating unit 3 which receives sections 5 from the outlets 2*a* of the pipes 2, an orientation changing or deflecting unit 4 which is located downstream of the separating unit 3, as considered in the direction of transport of sections 5, and a removing or transferring unit 6 which follows the unit 4 and serves to deliver a multi-layer stream 105 of sections 5 to a processing or consuming machine, e.g., into the magazine or hopper 54 of a filter tipping machine wherein the sections 5 are processed and assembled with plain cigarettes, cigars or cigarillos to form filter cigarettes, cigars or cigarillos of unit length or multiple unit length.

The separating unit 3 comprises two sections or halves, one for each of the pipes 2. It goes without saying that the number of sections in the separating unit 3 is increased to three or more if the transporting unit 1 comprises three or more pipes 2, i.e., the number of sections in the separating unit 3 matches the number of pipes 2 in the transporting unit 1. In addition to comprising two sections or halves, the separating unit 3 comprises a velocity uniformizing device 7 and an accelerating device 8 which is located downstream of the device 7. One-half of each of the devices 7 and 8 belongs to one section or half, and the other half of each of the devices 7 and 8 belongs to the other section or half of the separating unit 3. The device 7 comprises two pairs of rotary elements in the form of rolls 9, 12 and 11, 13. The peripheral surfaces of these rolls have circumferential grooves or flutes bounded by surfaces having a semicircular cross-sectional outline (see the grooves or flutes 17 of the rolls 12 and 13 shown in FIG. 2). A filter rod section 5 (hereinafter called plug or filter plug for short) which leaves the outlet 2a of the left-hand pipe 2 of FIG. 1 enters the nip of the rolls 9, 12 which are driven at a given speed and whose peripheral surfaces engage the plug so that the speed of the plug conforms to the peripheral speed of the rolls 9 and 12. Analogously, a plug 5 which leaves the outlet 2a of the right-hand pipe 2 of FIG. 1 is engaged by the peripheral surfaces of the rolls 11, 13 and its speed is increased or reduced to match the peripheral speed of these rolls. In other words, the speed of each plug 5 which advances beyond the rolls 9, 12 or 11, 13 matches a predetermined speed.

The rolls 9 and 11 are mounted on a shaft 14, and the rolls 11, 13 are mounted on a shaft 16. The axes of the shafts 14, 16 are parallel to each other and are located in a common plane which is normal to the axes of the outlets 2a. Each of the rolls 9, 11, 12 and 13 is rotatable on the respective shaft 14 or 16. The distance between the common central plane of the rolls 9, 12 and the common central plane of the rolls 11, 13 is identical with the distance between the axes of the outlets 2a. The radii of curvature of the flutes or grooves 17 in the peripheral surfaces of the rolls 9, 11, 12 and 13 match or approximate the radii of plugs 5. The rolls 9 and 11 are idler rolls, i.e., they are always free to rotate relative to or with their shaft 14, depending upon whether the shaft 14 rotates in its bearings. The manner in which the shafts 14 and 16 are journalled in the frame of the apparatus including the units 1, 3, 4 and 6 forms no part of the present invention.

The accelerating device 8 of the separating unit 3 also comprises two pairs of rotary elements or rolls 18, 19 and 21, 22. The rolls 18 and 21 are freely rotatable on a shaft 23, i.e., each of these rolls can rotate independently of the other, the same as the rolls 9, 11, 12 and 13 of the velocity uniformizing device 7. The rolls 21 and 22 are free to rotate on a shaft 24. The pair of rolls 18 and 19 is located downstream of and its rolls register with the rolls of the pair of rolls 9 and 12. The rolls 21, 22 of the other pair of rolls of the device 8 are located downstream of and register with the rolls of the pair 11, 13. The peripheral surfaces of the rolls 18, 19, 21, 22 have circumferential grooves or flutes which are analogous to the aforediscussed flutes 17 and are bounded by surfaces serving to engage the external surfaces of plugs 5 which are advanced, at a predetermined uniform speed, beyond the rolls 9, 12 and 11, 13. The peripheral speed of the rolls 18, 19, 21, 22 exceeds the peripheral speed of the rolls 9, 11, 12, 13; therefore, each of the two files of plugs 5 formed by the outlets 2a and by the speed uniformizing device 7 is converted into a series of rod-shaped articles wherein the neighboring articles are separated from each other by clearances or gaps of predetermined width, or of a width which at least equals the predetermined width and wherein all of the articles continue to move axially.

The means for driving the mobile components of the separating unit 3 comprises a prime mover 26, e.g., a variable-speed electric motor which is mounted on the floor or in or on the frame of the apparatus. The output element of the prime mover 26 transmits torque to the shaft 16 for the rolls 12, 13 by way of a chain or belt transmission, here shown as a V-belt drive 27 whose belt is trained over pulleys 27a and 28 on the output element of the prime mover 26 and shaft 16 (see also FIG. 2). The pulley 28 is free to rotate on the shaft 16. The roll 12 is coaxial with and fixedly secured to a pulley 29 (shown in FIG. 2) which drives an endless belt 34. A further pulley 31 is coaxial with and fixedly secured to the roll 13; this pulley transmits torque to a further endless belt 36.

When the pulley 28 is to transmit torque to the roll 12 or 13 of the speed uniformizing device 7, it is necessary to respectively engage a first drive or clutch 32 and a second drive or clutch 33. These clutches are mounted on the shaft 16 and may constitute electromagnetically actuatable clutches of any known design. The endless belt 34 drives a pulley on the shaft 24, and such pulley transmits torque to the roll 19. Analogously, the belt 36 drives a second pulley on the shaft 24, and such second pulley transmits torque to the roll 22. The transmission ratio of the drives including the belts 34 and 36 is such that the peripheral speed of the rolls 19 and 22 exceeds the peripheral speed of the rolls 12 and 13; this gives rise to the development of aforediscussed clearances or gaps between the series of plugs 5 which are caused to advance beyond the accelerating device 8 of the separating unit 3. The plugs 5 of the two series of plugs which are advanced beyond the accelerating device 8 of the separating unit 3 then enter the corresponding deflecting devices or sections of the orientation changing or deflecting unit 4.

The separating device 3 further comprises two elongated parallel guide members or rails 37 and 38 which respectively extend between the rolls 12, 19 and 13, 22 and serve to guide the plugs 5 of the respective files toward the nips of the rolls 18, 19 and 21, 22. The upper sides of the rails 37, 38 are preferably formed with flutes bounded by semicylindrical surfaces whose radii of curvature match or approximate the radii of plugs 5.

The grooves or flutes 17 in the peripheral surfaces of the rolls 9 and 12, similar grooves or flutes in the peripheral surfaces of the rolls 18, 19 and the groove or flute in the upper side of the rail 37 define a first lane or path for the plugs 5 which issue from the left-hand outlet 2a shown in FIG. 1 and advance toward the orientation changing device 4. The second lane or path extends from the right-hand outlet 2a of FIG. 1 to the corresponding deflecting device of the orientation changing unit 4 and is defined by the peripheral grooves or flutes of the rolls 11, 13, by the groove or flute in the upper side of the rail 38, as well as by the grooves or flutes in the peripheral surfaces of the rolls 21, 22.

Each deflecting device of the orientation changing unit 4 comprises an upright channel or duct. These ducts are respectively shown at 39, 41 and are respectively flanked by pairs of vertical side walls 40 and 45. The rolls 18, 19 propel successive plugs 5 of the corresponding series of axially spaced plugs into the upper portion of the channel 39, and the rolls 21, 22 propel successive plugs 5 of the respective series of axially spaced plugs into the upper portion of the channel 41. Thus, the orientation changing device 4 also defines two lanes or paths for the transport of plugs 5 toward the removing or transferring unit 6. The speed of filter plugs 5 which enter the channels 39 and 41 is constant, i.e., such speed is determined by the peripheral speed of the rolls 18, 19 and 21, 22 in the accelerating device 8 of the separating unit 3.

The channels 39 and 41 accommodate suitable deflecting members which change the direction of movement of successive filter plugs 5 from axial movement to sidewise or transverse movement. Suitable deflecting members are disclosed, for example, in the aforementioned German Offenlegungsschrift No. 2,641,934 as well as in the aforementioned U.S. Pat. No. 3,222,110 to Kelly et al. FIG. 1 shows, very schematically, a portion of a deflecting member 139 which is disposed in or above the channel 39 and serves to change the direction of movement of filter plugs 5 which are propelled into the orientation changing unit 4 by the rolls 18 and 19. A second deflecting member 141 is installed in or above the channel 41 to change the direction of movement of plugs 5 which are propelled into the channel 41 by the rolls 21, 22. Each of the deflecting members 139, 141 is a nozzle which discharges one or more jets of compressed air or another gaseous fluid at a speed sufficing to ensure that the axial or lengthwise movement of successive plugs 5 is transformed into a sidewise or lateral movement. Thus, the plugs 5 which enter into and descend in the channels 39 and 41 form two rows whose constituents move sideways and enter a common junction zone 42 wherein the plugs 5 form the multi-layer stream 105. The plugs 5 of the stream 105 are parallel to each other and are transported in the direction of arrow 60 by the upper reach of an endless belt conveyor 43 of the removing or transferring unit 6. The conveyor 43 is trained over rollers or pulleys 44, 46 and its exterior is provided with suitably distributed parallel ribs 49 or analogous protuberances serving to promote the desirable orientation of plugs 5 which form the stream 105. Thus, the ribs 49 ensure that the plugs 5 continue to move sideways after they leave the junction zone 42. The roller or pulley 46 is driven by a prime mover 48 (e.g., a constant-speed electric motor) through the medium of a variable-speed transmission 47 of any known design.

The transformation of two discrete rows of plugs 5 which move sideways into a multi-layer stream 105 whose constituents continue to move sideways is optional. Such transformation is preferred at this time because it saves space and results in a simplification of the corresponding portion of the apparatus. Transformation of two discrete rows of parallel plugs 5 which descend in the channels 39 and 41 into a single-multi-layer stream 105 is achieved by the simple expedient of enabling the open lower ends of the channels 39 and 41 to communicate with a common junction zone 42 whose open underside is adjacent to the upper reach of the conveyor 43. The open underside of the junction zone 42 is located above the right-hand portion of the upper reach of the conveyor 43; the left-hand portion of this conveyor discharges successive increments of the layer 105 into the magazine or hopper 54 of a consuming or processing machine, e.g., a filter tipping machine of the type known as MAX S produced and sold by the assignee of the present application.

The apparatus further comprises adjusting means including means for monitoring the delivery of plugs 5 via pipes 2 and/or the delivery of plugs 5 via channels 39, 41. The monitoring means serve to adjust the drive means so as to ensure that one lane of several lanes which are defined by the units 3 and 4 ceases to deliver plugs 5 when the corresponding pipe 2 is clogged and/or when the corresponding channel 39 or 41 is clogged or ceases to permit the passage of plugs 5 therethrough in a predetermined or optimum way. The monitoring means comprise discrete photoelectric detectors in the form of photocells each of which includes a light source and a signal generating photoelectric transducer of any known design. A first photocell 58 monitors the delivery of plugs 5 via left-hand pipe 2 of FIG. 1; a second photocell 59 monitors the delivery of plugs 5 via right-hand pipe 2 of FIG. 1; a third photocell 56 is mounted in the orientation changing unit 4 to monitor the passage of plugs 5 through the channel 39 and the delivery of plugs to the corresponding inlet of the junction zone 42; and a fourth photocell 57 is installed in the unit 4 to monitor the delivery of plugs 5 via channel 41 and onto the other inlet of the junction zone 42.

The operation is as follows:

Filter plugs 5 which are delivered by the outlets 2*a* of the pipes 2 of the pneumatic transporting unit 1 enter the separating unit 3. The surfaces of such plugs are engaged by the peripheral surfaces of the rolls 9, 12 and 11, 13 in the velocity uniformizing device 7 so that each plug 5 which enters the flute of the rail 37 or 38 advances lengthwise at a speed which matches a given speed. In other words, the speed of all filter plugs 5 which are in the process of entering the accelerating device 8 of the separating unit 3 is the same. Successive filter plugs 5 of the two discrete files of filter plugs are accelerated on entry into the nips of the rolls 18, 19 and 21, 22 so that each preceding filter plug is moved forwardly and away from the next-following plug with resultant establishment of clearances or gaps in the thus obtained discrete series of filter plugs which continue to move axially, i.e., lengthwise. The clearances between neighboring filter plugs of each series suffice to ensure that the downward movement (deflection) of successive filter plugs which enter the channels 39 and 41 of the orientation changing unit 4 cannot be obstructed by the next-following plugs of the respective series while the preceding plugs are caused to change the direction of their movement from axial movement to sidewise movement under the action of streams of gaseous fluid issuing from the orifices of nozzles 139 and 141. These nozzles can be replaced with or used in addition to purely mechanical deflecting members, e.g., wedge-like deflectors having suitably inclined cam faces which cause the oncoming filter plugs to descend in the respective channels 39, 41 and to constitute the uppermost plugs of the two rows which accumulate in the lower portions of these channels and descend into the junction zone 42 at a rate depending on the speed of the upper reach of the conveyor 43 in the removing or transferred unit 6. The junction zone 42 cooperates with the conveyor 43 to form the multi-layer stream 105 which is fed into the magazine 54 of the processing or consuming machine. The open underside of the junction zone 42 is located in the region of the receiving end of the conveyor 43 (namely, above the right-hand end of the upper reach of this conveyor), and the speed of the conveyor 43 can be varied by the transmission 47 whose input element receives motion from the output element of the prime mover 48. The height of the multi-layer stream 105 on the conveyor 43 is limited by a mobile cover here shown as the lower reach of a second endless belt conveyor 51 which is trained over pulleys or rollers 52 and 53. The lower reach of the conveyor 51 is parallel to the upper reach of the conveyor 43. The manner in which the filter plugs 5 are withdrawn from the magazine 54 and conveyed through various stations of the corresponding processing machine forms no part of the present invention. If the processing machine is a filter tipping machine of the type known as MAX S, the filter plugs 5 are of multiple (e.g., six times) unit length and are converted into a single row of filter plugs of double unit length. Each such plug is placed between two plain cigarettes of unit length and is attached to the respective plain cigarettes by an adhesive-coated uniting band to form a row of filter cigarettes of double unit length. Such cigarettes are tested and halved so that each thereof yields two filter cigarettes of unit length which are tested again, some of which are inverted, and which are thereupon delivered to a take-off conveyor for transport into a reservoir (e.g., a reservoir of the type known as RESY which is manufactured by the assignee of the present application) or into a packing machine.

When the apparatus of the present invention operates normally, the rolls 12 and 13 of the velocity uniformizing device 7 in the separating unit 3 are connected to the prime mover 26 by the respective clutches 32 and 33. These clutches are driven by the pulley 28 which, in turn, is driven by the belt 27 and pulley 27*a* on the rotary output element of the prime mover 26. If one of the photocells 58, 59 detects improper delivery of plugs 5 to the respective lane of the separating unit 3, e.g., if one of the pipes 2 is clogged, the corresponding clutch 32 or 33 is actuated in a sense to disengage the respective roll 12 or 13 from the prime mover 26. Thus, the roll 12 or 13 ceases to advance the plugs 5 of the respective file toward the rolls 18, 19 or 21, 22.

It is now assumed that the photocell 58 has detected a pileup of plugs 5 in the left-hand pipe 2 of FIG. 1. This results in disengagement of the clutch 32 so that the latter ceases to drive the pulley 29 which, in turn, ceases to drive the roll 12 and also ceases to drive the roll 19 by way of the belt 34. The clutch 33 continues to drive the roll 13 via pulley 31, and the latter continues to drive the roll 22 via belt 36. Thus, one lane of the composite path for the delivery of plugs 5 to the channels 39, 41 is idle but the other channel (namely, the channel 41) continues to receive filter plugs 5 at the normal rate.

It will be noted that the generation of a "defect" or "malfunction" signal by the photocell 58 results in an interruption of delivery of one-half of the normal quantity of filter plugs 5 to the junction zone 42. However, and since the latter continues to receive a row of filter plugs (from the open lower end of the channel 41), the conveyor 43 continues to deliver a multi-layer stream 105 of filter plugs into the magazine 54 (but at a reduced speed). The attendant or attendants note that one-half of the apparatus is adle and can undertake the necessary steps to eliminate the cause of a pileup in the left-hand pipe 2 while the other pipe 2 continues to feed filter plugs 5 into the nip of the rolls 11 and 13. It is clear that, if the number of pipes 2 exceeds two, the percentage of filter plugs which enter the junction zone 42 per unit of time is higher than 50 percent when a single pipe 2 of the transporting unit 1 ceases to deliver filter plugs to the corresponding section of the separating unit 3. Thus, if the number of pipes 2 is four, and one of the pipes is clogged, the quantity of filter plugs which enter the junction zone 42 per unit of time is reduced by only 25 percent.

The generation of a signal by the photocell 59 results in disengagement of the clutch 33, i.e., the prime mover 26 ceases to transmit torque to the roll 13, and the pulley 31 ceases to transmit torque to the roll 22. Therefore, the delivery of filter plugs 5 into the channel 41 is interrupted.

The function of the photocells 56 and 57 is preferably the same as that of the photocells 58 and 59, respectively. Thus, when the photocell 56 detects a pileup of plugs 5 in the channel 39, it transmits a signal to the clutch 32 which is disengaged and ceases to rotate the rolls 12 and 19. A signal from the photocell 57 results in disengagement of the clutch 33 which arrests the rolls 13 and 22.

The speed of the pulley 46 can be varied in automatic response to changes in the rate of delivery of filter plugs 5 from the junction zone 42 into the space between the conveyors 43 and 51 of the transferring unit 6. This ensures that the rate at which the junction zone 42 delivers plugs 5 to the conveyor 43 invariably matches the rate at which the conveyor 43 delivers filter plugs into the magazine 54. The means for monitoring the rate of delivery of filter plugs 5 from the junction zone 42 onto the conveyor 43 is not specifically shown in the drawing; such means may include a level detector in the space between the conveyors 43, 51 and a suitable operative connection between the level detector and the transmission 47. The transmission 47 can be omitted if the prime mover 48 is a variable-speed motor.

An important advantage of the improved apparatus is that the delivery of filter plugs 5 to the magazine 54 need not be completely interrupted as long as at least one pipe 2 of the transporting unit 1 continues to deliver filter plugs at the prescribed rate. The elimination of malfunction of a given portion of the transporting unit 1 normally does not take up a relatively long interval of time, i.e., the apparatus can be caused to again deliver rod-shaped articles at the normal maximum rate after elapse of a relatively short interval of time following detection of malfunction by one of the photocells 56, 57, 58 and 59. The operative connections between the photocells 56–59 and a control unit CU which, in turn, energizes or deenergizes the clutches 32 and 33 are indicated at 61. The specific construction of the unit CU forms no part of the present invention. As mentioned above, the clutches 32 and 33 can be electromagnetically operated clutches of any known design.

Figure 2:
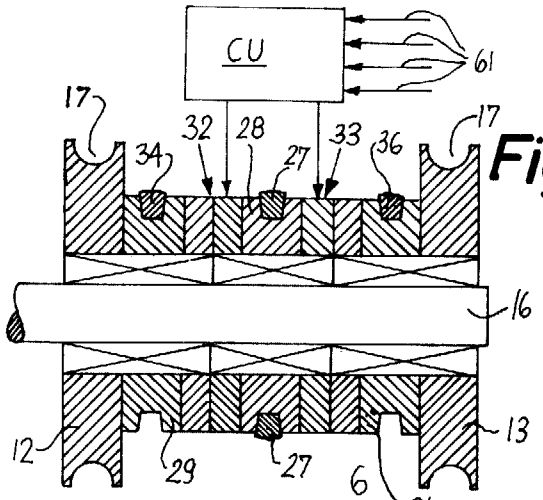
FIG. 2 is an enlarged sectional view of a portion of the separating unit as seen in the direction of arrows from the line II—II of FIG. 1.
Figure 3:
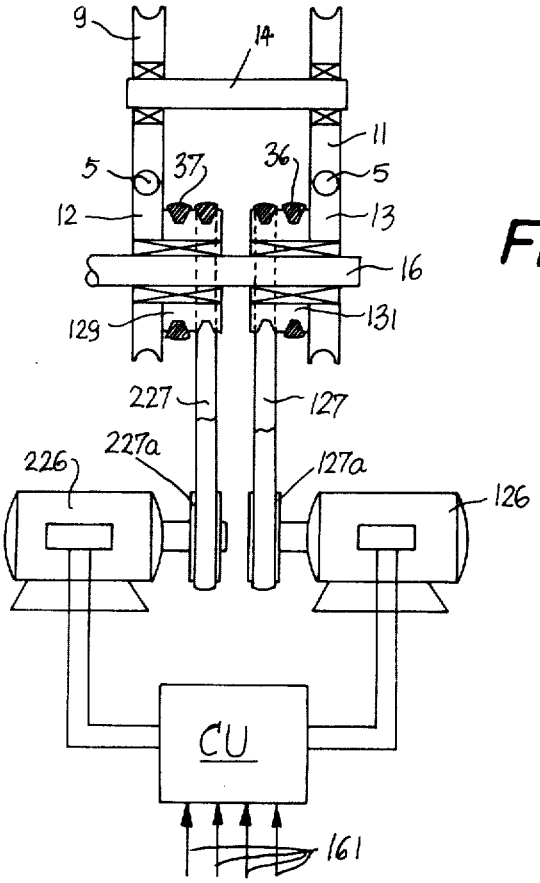
FIG. 3 is a sectional view of a portion of another embodiment of the separating unit as seen in the direction of arrows III in FIG. 1.

It will be readily appreciated that the improved apparatus can be modified in a number of ways without departing from the spirit of the invention. One example is shown in FIG. 3 which is a sectional view of a portion of the separating unit as seen in the direction of arrows III of FIG. 1. Each in the pulleys 129, 131 (i.e., each of the rolls 12, 13) receives torque from a discrete drive or prime mover 226, 126 by way of pulleys 227*a* and 127*a* and chain or belt transmissions 227 and 127 respectively, in FIG. 3 shown as V-belt drives. The prime mover 226 or 126 is arrested when the corresponding photocell transmits a signal. Thus, the discrete drive or prime mover 226 for the roll 12 can be arrested in response to a signal from the photocell 58 or 56, and the discrete drive or prime mover 126 for the roll 13 can be arrested in response to a signal from the photocell 59 or 57. The signals from the photocells are transmitted to the control unit CU by way of connections 161 and the control unit, in turn, energizes or deenergizes the prime movers 226 and 126 respectively. The main difference between the just described modification with discrete drives or prime movers for the rolls 12, 13 and the embodiment which is shown in the FIGS. 1 and 2 is that the embodiment of FIGS. 1 and 2 employs a single prime mover 26 which continuously drives the pulley 28 and the latter can transmit torque to the roll 12 and/or 13 in response to en gization of the clutch 32 and- /or 33. Such embodiment is simpler, more compact and less expensive than the just discussed modification because it employs a single prime mover (26) for both driven rolls of the velocity uniformizing device 7 in the separating unit 3. An advantage of the modification shown in FIG. 3 is that the speeds of the discrete prime movers 226 and 126 can be controlled independently of each other. This renders it possible to control the velocity of articles in each of the paths of the separating unit 3 independently from the other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating rod-shaped articles between at least one producing machine and at least one processing machine, particularly for manipulating filter rod sections prior to admission into a filter tipping machine, comprising a pneumatic transporting unit having a plurality of discrete tubular conveyors for the transport of articles along separate paths, each of said tubular conveyors having an outlet for discharge of articles in the form of a file wherein the articles move lengthwise; a separating unit including discrete sections, one for each of said tubular conveyors, and each of said sections having means for converting the respective file into a series of axially spaced articles which continue to move lengthwise, each of said converting means comprising at least one rotary article engaging and advancing element; adjustable drive means for rotating each such rotary element independently of each other rotary element so that any one of said sections can continue with or interrupt the conversion of the respective file into a series of axially spaced articles independently of each other section; an orientation changing unit including discrete deflecting devices, one for each of said sections, each of said devices including means for changing the direction of movement of successive articles of the series of articles issuing from the respective section so that each of said series is transformed into a row wherein the articles move sideways; and means defining a common junction zone for reception of articles from said discrete deflecting devices and for conversion of the thus received articles into a stream wherein the articles move sideways.

2. The apparatus of claim 1, wherein each section of said separating unit comprises a first rotary article engaging and advancing element and a second rotary article engaging and advancing element located downstream of the first element, as considered in the direction of movement of articles in the respective series, said drive means including means for normally rotating the second element of each of said sections at a speed exceeding the speed of the respective first element.

3. The apparatus of claim 1, wherein said drive means comprises a discrete drive for the rotary element of each section of said separating unit and discrete adjusting means for each of said drives so that the rotary element of any selected section can be started or arrested independently of the rotary element of each other section.

4. The apparatus of claim 1, wherein said drive means comprises a prime mover, a discrete drive for the rotary element of each section of said separating unit, and means for transmitting torque from said prime mover to said drives.

5. The apparatus of claim 4, wherein each of said drives includes a clutch and further comprising control means for engaging or disengaging said clutches independently of each other so that the rotary element of any selected section can be started or arrested independently of the rotary element of each other section.

6. The apparatus of claim 5, wherein at least one of said clutches is an electromagnetically operated clutch.

7. The apparatus of claim 1, wherein each of said devices comprises a substantially upright duct.

8. Apparatus for manipulating rod-shaped articles between at least one producing machine and at least one processing machine, particularly for manipulating filter rod sections prior to admission into a filter tipping machine, comprising a pneumatic transporting unit having a plurality of discrete tubular conveyors for the transport of articles along separate paths, each of said tubular conveyors having an outlet for discharge of articles in the form of a file wherein the articles move lengthwise; a separating unit including discrete sections, one for each of said tubular conveyors, and each of said sections having means for converting the respective file into a series of axially spaced articles which continue to move lengthwise, each of said converting means comprising at least one rotary article engaging and advancing element; adjustable drive means for rotating each such rotary element independently of each other rotary element; an orientation changing unit including discrete deflecting devices, one for each of said sections, each of said devices including means for changing the direction of movement of successive articles of the series of articles issuing from the respective section so that each of said series is transformed into a row wherein the articles move sideways; and means for adjusting said drive means, including signal generating means for monitoring the transport of articles in said tubular conveyors and means for interrupting the connection between said drive means and a selected rotary element when the signal from said monitoring means denotes an irregularity in delivery of articles to the section including said selected rotary element.

9. Apparatus for manipulating rod-shaped articles between at least one producing machine and at least one processing machine, particularly for manipulating filter rod sections prior to admission into a filter tipping machine, comprising a pneumatic transporting unit having a plurality of discrete tubular conveyors for the transport of articles along separate paths, each of said tubular conveyors having an outlet for discharge of articles in the form of a file wherein the articles move lengthwise; a separating unit including discrete sections, one for each of said tubular conveyors, and each of said sections having means for converting the respective file into a series of axially spaced articles which continue to move lengthwise, each of said converting means comprising at least one rotary article engaging and advancing element; adjustable drive means for rotating each such rotary element independently of each other rotary element; an orientation changing unit including discrete deflecting devices, one for each of said sections, each of said devices including means for changing the direction of movement of successive articles of the series of articles issuing from the respective section so that each of said series is transformed into a row wherein the articles move sideways; and means for adjusting said drive means, including signal generating means for monitoring the transport of articles in said devices of said orientation changing unit and means for interrupting the connection between said drive means and a selected rotary element when the signal from said monitoring means denotes an irregularity in transport of articles within the device receiving articles from the section including said selected rotary element.

10. Apparatus for manipulating rod-shaped articles between at least one producing machine and at least one processing machine, particularly for manipulating filter rod sections prior to admission into a filter tipping machine, comprising a pneumatic transporting unit having a plurality of discrete tubular conveyors for the transport of articles along separate paths, each of said tubular conveyors having an outlet for discharge of articles in the form of a file wherein the articles move lengthwise; a separating unit including discrete sections, one for each of said tubular conveyors, and each of said sections having means for converting the respective file into a series of axially spaced articles which continue to move lengthwise, each of said converting means comprising at least one rotary article engaging and advancing element; adjustable drive means for rotating each such rotary element independently of each other rotary element; an orientation changing unit including discrete deflecting devices, one for each of said sections, each of said devices including means for changing the direction of movement of successive articles of the series of articles issuing from the respective section so that each of said series is transformed into a row wherein the articles move sideways; and means for adjusting said drive means so that the rotary element of any selected section can be started or arrested independently of the rotary element of each other section, said adjusting means including signal generating monitoring means in said tubular conveyors, said monitoring means including photoelectronic transducer means.

11. Apparatus for manipulating rod-shaped articles between at least one producing machine and at least one processing machine, particularly for manipulating filter rod sections prior to admission into a filter tipping machine, comprising a pneumatic transporting unit having a plurality of discrete tubular conveyors for the transport of articles along separate paths, each of said tubular conveyors having an outlet for discharge of articles in the form of a file wherein the articles move lengthwise; a separating unit including discrete sections, one for each of said tubular conveyors, and each of said sections having means for converting the respective file into a series of axially spaced articles which continue to move lengthwise, each of said converting means comprising at least one rotary article engaging and advancing element; adjustable drive means for rotating each such rotary element independently of each other rotary element; an orientation changing unit including discrete deflecting devices, one for each of said sections, each of said devices including means for changing the direction of movement of successive articles of the series issuing from the respective section so that each of said series is transformed into a row wherein the articles move sideways; and means for adjusting said drive means so that the rotary element of any selected section can be started or arrested independently of the rotary element of each other section, said adjusting means including signal generating monitoring means in said devices, said monitoring means including photoelectronic transducer means.

* * * * *